US006244737B1

(12) United States Patent
Rittner et al.

(10) Patent No.: US 6,244,737 B1
(45) Date of Patent: Jun. 12, 2001

(54) ELECTRIC LAMP

(75) Inventors: Roland Rittner, Herbrechtingen; Uwe Kantim, Heidenheim; Werner Kast, Bergheim, all of (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/447,027

(22) Filed: Nov. 22, 1999

(30) Foreign Application Priority Data

Dec. 1, 1998 (DE) ..... 198 55 412

(51) Int. Cl.[7] ..... F21V 7/04

(52) U.S. Cl. ..... 362/549; 362/457; 362/548; 362/549

(58) Field of Search ..... 362/549, 365, 362/368, 374, 457, 548

(56) References Cited

U.S. PATENT DOCUMENTS 4,569,005 * 2/1986 Bergin et al. ..... 362/267
4,631,651 * 12/1986 Berggine et al. ..... 362/267
4,768,139 * 8/1988 Poppenheimer ..... 362/302
5,029,057 * 7/1991 Devir et al. ..... 362/226
5,634,705 * 6/1997 Michino ..... 362/61

FOREIGN PATENT DOCUMENTS 75 16 486 11/1976 (DE) .
216 575 A1 12/1984 (DE) .
196 16 409 A1 10/1997 (DE) .
2 042 823 9/1980 (GB) .

* cited by examiner

*Primary Examiner*—Sandra O'Shea
*Assistant Examiner*—John Anthony Ward
(74) *Attorney, Agent, or Firm*—William E. Meyer

(57) ABSTRACT

The invention relates to a motor vehicle headlight lamp having a metal-plastic cap whose electric connections are constructed as contact lugs (16, 17). According to the invention, the two contact lugs (16, 17) in each case have a groove (16*c*, 17*c*) in which in each case a supply lead wire (12, 13) which is guided out of the lamp bulb is fixed to the corresponding contact lug (16, 17) by a welded joint. Furthermore, the contact lugs (16, 17) are equipped with means (16*f*, 17*f*) for threading the supply lead wires (12, 13) into the respective groove (16*c*, 17*c*) and the lamp cap has at least one cut-out (18) which serves the purpose of carrying out the welding of the supply lead wires (12, 13), arranged in the grooves (16*c*, 17*c*), to the contact lugs (16, 17).

10 Claims, 2 Drawing Sheets

ELECTRIC LAMP

TECHNICAL FIELD

The invention relates to electric lamps and particularly to automobile lamps. More particularly the invention is concerned with the coupling socket structure of an automobile lamp.

BACKGROUND ART

Such an electric lamp is disclosed, for example, in the International Patent Application WO 97/40521. This laid-open patent application describes an electric incandescent lamp, in particular a motor vehicle headlight lamp, having an incandescent filament enclosed in a vitreous lamp bulb and a lamp cap consisting of metal and plastic parts. The end, sealed in a gas tight fashion, of the lamp bulb is fixed in a metal holder which, for its part, is anchored in the plastic cap part provided with the electric connections of the lamp. The supply leads, which are guided out of the lamp bulb and connected to the incandescent filament, are welded in the interior of the plastic cap part to the electric connections of the lamp, which are constructed as contact lugs. For the purpose of welding the supply lead and contact lug, the contact lugs in each case have a bore through which the corresponding supply lead is guided. The supply lead ends guided through the bore are welded to the contact lug. The interior of the plastic cap part is closed with a cover. For the purpose of sealing against the ingression of air humidity, the lamp cap has silicon sleeves through which the supply leads are guided, and which are arranged with a press fit in the bushings of the plastic cap part for the supply leads. The press fit is produced with the aid of the contact lugs, which exert a pressure on the silicon sleeves.

DISCLOSURE OF THE INVENTION

BEST MODE FOR CARRYING OUT THE INVENTION

Figure 1:
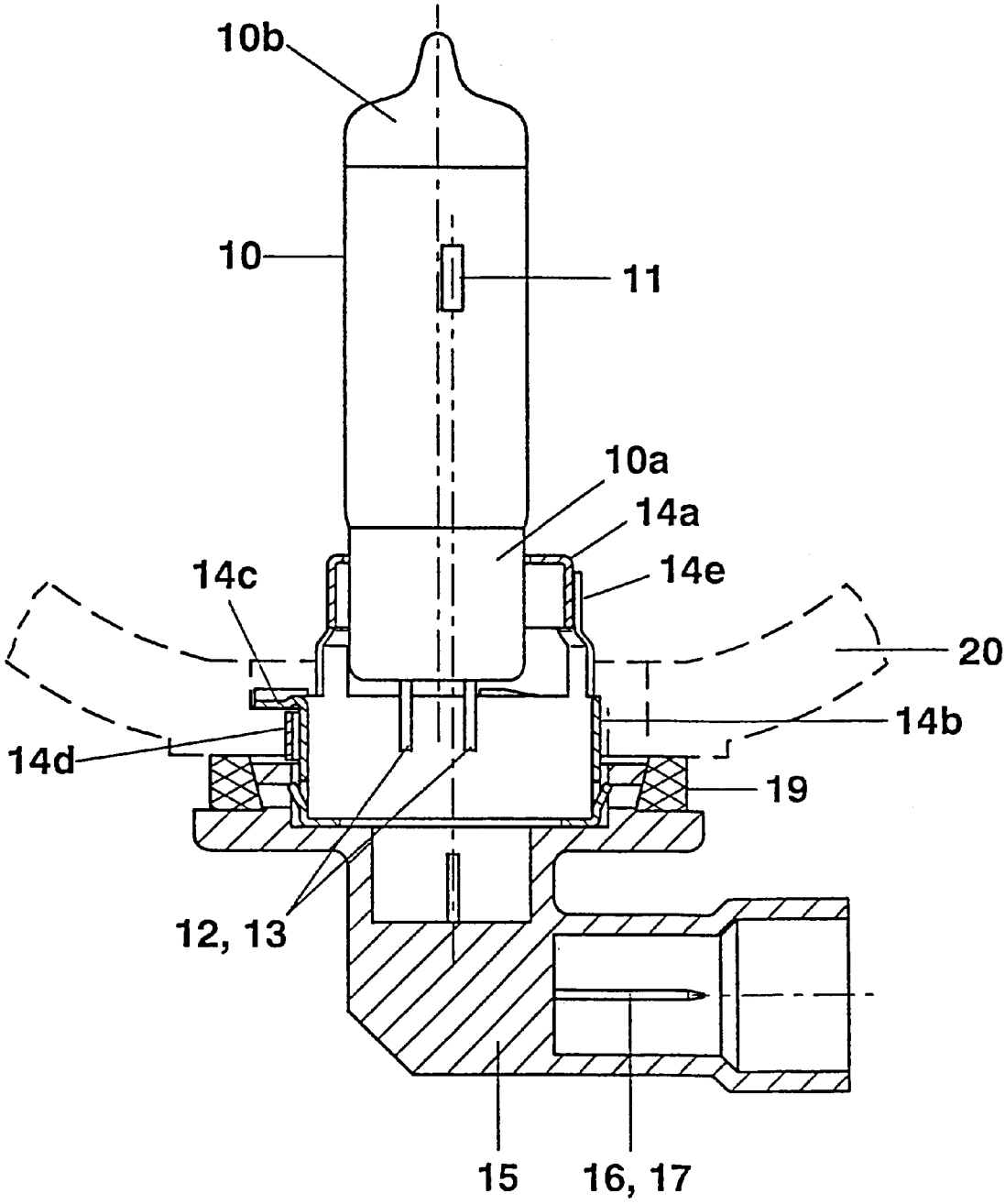
FIG. 1 shows a diagrammatic representation of the preferred embodiment of the lamp with the reflector partially sectioned.

It is the object of the invention to provide an electric lamp having an improved lamp cap and, in particular, having improved electric connections.

The electric lamp according to the invention has a lamp cap, a transparent lamp bulb, at least one luminous means surrounded by the lamp bulb, at least two supply lead wires, guided out of the lamp bulb, for supplying power to the at least one luminous means, and a holder for the lamp bulb as well as a plastic cap part, which is provided with the electric connections, constructed as at least two contact lugs, of the lamp, and in which the holder is anchored. According to the invention, the at least two contact lugs in each case have a groove in which in each case a supply lead wire is fixed to the corresponding contact lug by a welded joint. Furthermore, the at least two contact lugs according to the invention are equipped with means for threading the supply lead wires into the respective groove. The lamp cap further has at least one cut-out serving the purpose of carrying out the welding of the supply lead wires to the contact lugs.

The abovementioned features of the lamp according to the invention permit the contact lugs to be injection molded in the plastic cap part, and permit dispensing with additional means for sealing the lamp cap against the ingression of air humidity such as, for example, silicon sleeves or potting compound. Moreover, there is also no need for a cover to close the cap interior. The welded joint between the supply lead wires and contact lugs is made, in the case of the lamp according to the invention, with the aid of a laser, for example, by a tiny cut-out in the lamp cap. The abovementioned cut-out is advantageously arranged in the holder, and not in the sealed plastic cap part. For the purpose of producing the abovenamed welded joint, it is advantageous, because of the low melting temperature, to heat the contact lugs, consisting of steel sheet, and not the supply lead wires produced from molybdenum.

The means for threading the supply lead wires advantageously have for each groove two webs which delimit the groove laterally, the edge, facing the groove, of at least one of these webs being provided with a slant. In the particularly preferred exemplary embodiment of the invention, the edges, facing the groove, of the two webs have a slant in each case. These slants ensure that during mounting of the lamp the supply lead wire ends are automatically threaded without a problem into the grooves of the contact lugs. The two webs delimiting the groove advantageously have different lengths. Consequently, the longer web can serve as a guiding aid for the supply lead wire to be threaded. The shorter of the two webs advantageously has a lesser width than the longer web. This facilitates the welding of the supply lead wire and contact lug, because in order to weld the two abovenamed components, only the material of the shorter web need be heated briefly above the melting point thereof. After the heated material has solidified, the supply lead wire is connected to the shorter web by means of a welded joint.

The preferred exemplary embodiment of the invention is a single-filament halogen incandescent lamp which is provided for use in a motor vehicle headlight. This lamp has a vitreous, essentially cylindrical lamp bulb having a pinch foot 10*a* sealed in a gas tight fashion. The dome 10*b* of the lamp bulb 10 is provided with a light-absorbing coating. Serving as light source is an incandescent filament 11 which is aligned parallel to the lamp bulb axis and is connected in an electrically conductive fashion to two supply leads 12, 13 which are guided out of the pinch foot 10*a* and consist of molybdenum wire. The pinch foot 10*a* of the lamp bulb 10 is fixed in a metal holder which consists of the cup-like holder part 14*a,* the intermediate ring 14*e* and the annular carrier sleeve 14*b*. In addition to the metal holder 14*a,* 14*b,* the lamp cap also has a plastic cap part 15 which is provided with the electric connections 16, 17 of the lamp and in which the annular metal carrier sleeve 14*b* is anchored. The carrier sleeve 14*b* has three reference noses 14*c,* situated in a plane, and a pressed on spring 14*d* for mounting the lamp in the reflector 20 of a motor vehicle headlight. The sealing of the reflector 20 is performed by means of a silicone sealing ring 19 which bears against the outer wall of the reflector 20 and against the plastic cap part 15. The design of the lamp in accordance with the preferred exemplary embodiment, and its use in a headlight are represented diagrammatically in FIG. 1.

Figure 2:
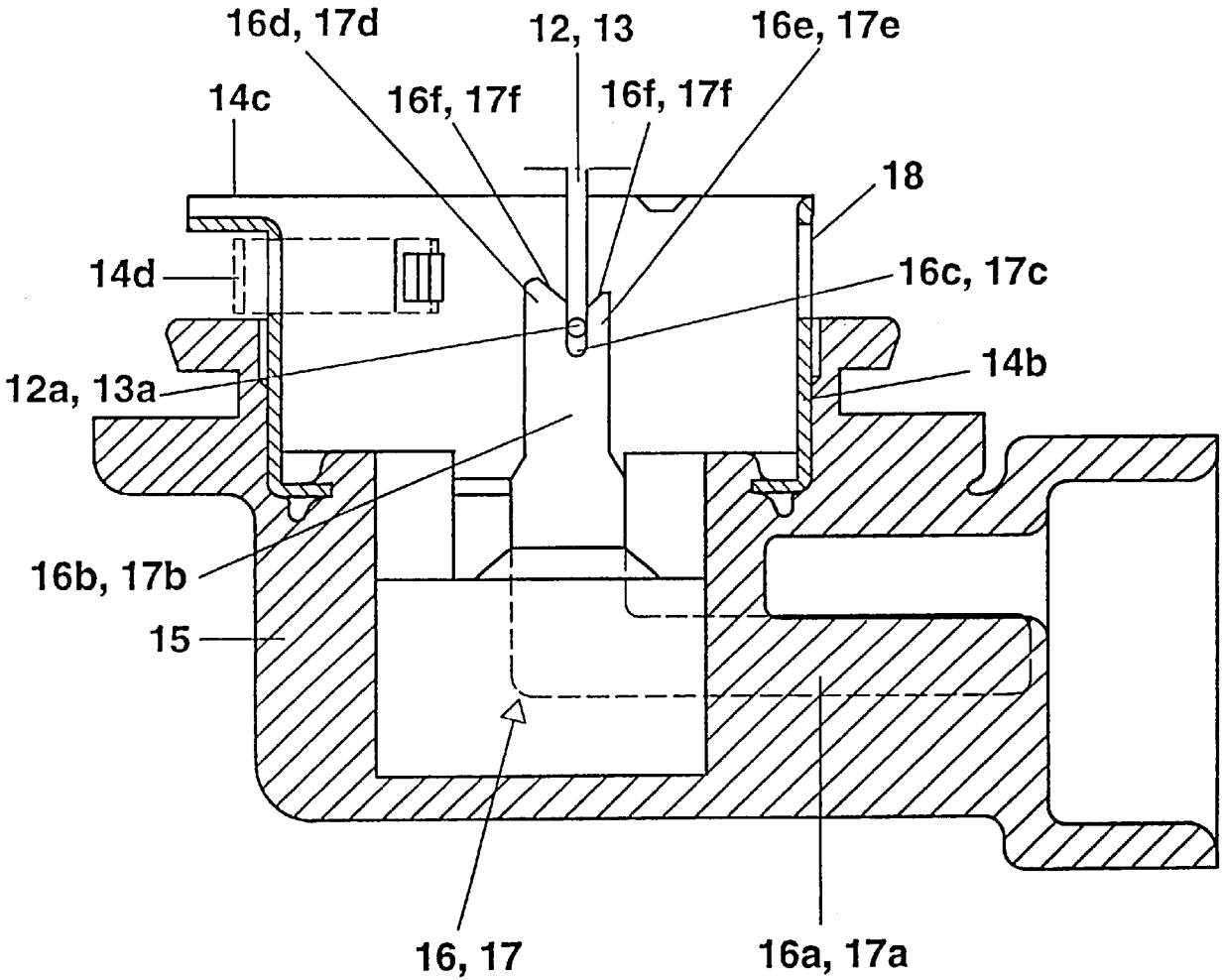
FIG. 2 shows a cross section through a part of the lamp base.

The electric connections 16, 17 of the lamp consist of two metal contact lugs 16, 17 which are welded in each case to one of the supply lead wires 12, 13 (not illustrated in FIG. 1). The contact lugs 16, 17 are made from a steel sheet and are injection molded in the plastic cap part 15 of the lamp cap. They 16, 17 consist in each case of an L-shaped steel sheet. In each case one limb 16*a,* 17*a* of the L-shaped contact lugs 16, 17 is constructed as a plug-in contact, while the other limb 16*b,* 17*b* is equipped with a groove 16*c,* 17*c* into which each case the angled end 12*a,* 13*a* of a supply lead wire 12, 13 is threaded. The regions, normally covered in the cross section of FIG. 2, of the contact lugs 16, 17 are represented by dashes in FIG. 2. The angle region of the L-shaped contact lugs 16, 17 is tightly injection molded in the plastic cap part 15 and is therefore normally not visible. The grooves 16*c,* 17*c* are laterally delimited in each case by two webs 16*d,* 16*e* or 17*d,* 17*e* of different length. Two webs 16*d,* 16*e* or 17*d,* 17*e* in each case have on their edge facing the groove 16*c,* 17*c* a slant 16*f,* 17*f* which serves to thread the supply lead wire 12, 13 into the groove 16*c,* 17*c*. The shorter web 16*e,* 17*e* has a lesser width than the longer web 16*d,* 17*d*. The welded joint between the supply lead wires 12, 13 and the contact lugs 16, 17 is produced by briefly heating the material on the shorter webs 16*e,* 17*e* above its melting point by means of a laser. After the solidification of the melt, the angled end 12*a,* 13*a* of the supply lead wire 12, 13 is connected to the shorter web 16*e,* 17*e*. The L-limbs 16*b,* 17*b* welded to the supply lead wires 12, 13 extend as far as into the interior formed by the carrier sleeve 14*b* anchored in the plastic cap part 15. The carrier sleeve 14*b* is provided at the level of the webs 16*d,* 16*e,* 17*d,* 17*e* with a cut-out 18 via which the laser welding of the supply lead wires 12, 13 to the shorter webs 16*e,* 17*e* of the corresponding contact lug 16, 17 is performed after the mounting of the lamp cap.

What is claimed is:

1. An electric lamp having a lamp cap, a transparent lamp bulb (10), and having at least one luminous means (11) surrounded by the lamp bulb (10), in which the lamp has at least two supply lead wires (12, 13), projecting from the lamp bulb (10), for supplying power to the at least one luminous means (11), the lamp cap has a holder (14*a,* 14*b,* 14*e*) for the lamp bulb (10), the lamp cap has a plastic cap part (15), which is provided with electric connections (16, 17) of the lamp and in which the holder (14*a,* 14*b,* 14*e*) is anchored, and the electric connections (16, 17) are constructed as at least two metal contact lugs (16, 17) which are connected in an electrically conducting fashion in each case to one of the supply lead wires (12, 13), characterized in that the at least two contact lugs (16, 17) in each case have a groove (16*c,* 17*c*) in which in each case a supply lead wire (12, 13) is fixed to the corresponding contact lug (16, 17) by a welded joint, the contact lugs (16, 17) have means (16*f,* 17*f*) for threading the supply lead wires (12, 13) into the respective groove (16*c,* 17*c*), and the lamp cap has at least one cut-out (18) which serves the purpose of carrying out the welding of the supply lead wires (12, 13), arranged in the grooves (16*c,* 17*c*), to the contact lugs (16, 17).

2. The electric lamp according to claim 1, characterized in that the means for threading in each case have for each groove (16*c,* 17*c*) two webs (16*d,* 16*e*; 17*d,* 17*e*) which laterally delimit the groove (16*c,* 17*c*), the edge, facing the groove (16*c,* 17*c*), of at least one of these webs (16*d,* 16*e*; 17*d,* 17*e*) being provided with a slant (16*f,* 17*f*).

3. The electric lamp according to claim 2, characterized in that the edges, facing the groove (16*c,* 17*c*), of the two webs (16*d,* 16*e;* 17*d,* 17*e*) are provided with a slant (16*f,* 17*f*).

4. The electric lamp according to claim 2, characterized in that the webs (16*d,* 16*e;* 17*d,* 17*e*) have a different length so that a first web (16*d,* 17*d*) is a relatively longer web, and a second web (16*e,* 17*e*) is a relatively shorter web.

5. The electric lamp according to claim 4, characterized in that the shorter web (16*e,* 17*e*) has a lesser width than the longer web (16*d,* 17*d*).

6. The electric lamp according to claim 4, characterized in that the supply lead wires (12, 13) are connected in each case to the shorter web (16*e,* 17*e*) by the welded joint.

7. The electric lamp according to claim 1, characterized in that the supply lead wires (12, 13) have angled ends (12*a,* 13*a*) which are welded to the contact lugs (16, 17).

8. The electric lamp according to claim 1, characterized in that the at least one cut-out (18) is arranged in the holder (14*a,* 14*e,* 14*b*).

9. An electric lamp having a lamp cap, a transparent lamp bulb (10), and having at least one luminous means (11) surrounded by the lamp bulb (10) in which the lamp has at least two supply lead wires (12, 13), projecting from the lamp bulb (10) for supplying power to the at least one luminous means (11), the lamp cap has a holder (14*a,* 14*b,* 14*e*) for the lamp bulb (10), the lamp cap has a plastic cap part (15), which is provided with electric connections (16, 17) of the lamp and in which the holder (14*a,* 14*b,* 14*e*) is anchored, and the electric connections (16, 17) are constructed as at least two metal contact lugs (16, 17) which are connected in an electrically conducting fashion in each case to one of the supply lead wires (12, 13), wherein the at least two contact lugs (16, 17) are injection molded in the plastic cap (15);

the at least two contact lugs (16, 17) in each case have a groove (16*c,* 17*c*) in which in each case a supply lead wire (12, 13) is fixed to the corresponding contact lug (16, 17) by a welded joint, the contact lugs (16, 17) have means (16*f,* 17*f*) for threading the supply lead wires (12, 13) into the respective groove (16*c,* 17*c*), and the lamp cap has at least one cut-out (18) which serves the purpose of carrying out the welding of the supply lead wires (12, 13), arranged in the grooves (16*c,* 17*c*), to the contact lugs (16, 17).

10. An electric lamp having a lamp cap, a transparent lamp bulb (10), and having at least one luminous means (11) surrounded by the lamp bulb (10), in which the lamp has at least two supply lead wires (12, 13), projecting from the lamp bulb (10), for supplying power to the at least one luminous means (11), the lamp cap has a holder (14*a,* 14*b,* 14*e*) for the lamp bulb (10), the lamp cap has a plastic cap part (15), which is provided with electric connections (16, 17) of the lamp and in which the holder (14*a,* 14*b,* 14*e*) is anchored, and the electric connections (16, 17) are constructed as at least two metal contact lugs (16, 17) which are connected in an electrically conducting fashion in each case to one of the supply lead wires (12, 13), wherein the at least two contact lugs (16, 17) are injection molded in the plastic cap (15);

the at least two contact lugs (16, 17) in each case have a groove (16*c,* 17*c*) in which in each case a supply lead wire (12, 13) is fixed to the corresponding contact lug (16, 17) and fused for electrical conduction to, and the lamp cap has at least one cut-out (18) which serves the purpose of carrying out the fusing of the supply lead wires (12, 13), arranged in the grooves (16*c,* 17*c*), to the contact lugs (16, 17).

* * * * *